US007059280B2

(12) United States Patent
Nohara et al.

(10) Patent No.: US 7,059,280 B2
(45) Date of Patent: Jun. 13, 2006

(54) VARIABLE COMPRESSION RATIO SYSTEM FOR INTERNAL COMBUSTION ENGINE AND METHOD FOR CONTROLLING THE SYSTEM

(75) Inventors: Tsuneyasu Nohara, Kanagawa (JP); Yoshiaki Tanaka, Kanagawa (JP); Shinichi Takemura, Yokohama (JP); Shunichi Aoyama, Kanagawa (JP)

(73) Assignee: Nissan Motor Co., Ltd., Yokohama (JP)

( * ) Notice: Subject to any disclaimer, the term of this patent is extended or adjusted under 35 U.S.C. 154(b) by 103 days.

(21) Appl. No.: 10/692,740

(22) Filed: Oct. 27, 2003

(65) Prior Publication Data

US 2004/0083992 A1 May 6, 2004

(30) Foreign Application Priority Data

Nov. 5, 2002 (JP) ..... 2002-320758

(51) Int. Cl.
*F02D 45/00* (2006.01)

(52) U.S. Cl. ..... 123/48 D

(58) Field of Classification Search ..... 123/48 R, 123/48 B, 48 D, 78 R, 78 BA, 78 E, 78 F, 123/78

See application file for complete search history.

(56) References Cited

U.S. PATENT DOCUMENTS

| | | | | |
|---|---|---|---|---|
| 5,595,146 | A * | 1/1997 | Bollig et al. | 123/48 B |
| 6,491,003 | B1 | 12/2002 | Moteki | |
| 6,516,757 | B1 * | 2/2003 | Aoyama et al. | 123/78 R |
| 6,595,186 | B1 * | 7/2003 | Hiyoshi et al. | 123/406.29 |
| 6,604,495 | B1 | 8/2003 | Moteki | |
| 6,691,655 | B1 * | 2/2004 | Aoyama et al. | 123/90.16 |

FOREIGN PATENT DOCUMENTS

JP 2002-115571 A 4/2002

* cited by examiner

*Primary Examiner*—Marguerite McMahon
(74) *Attorney, Agent, or Firm*—Foley & Lardner LLP

(57) ABSTRACT

A variable compression ratio system for an internal combustion engine, including a variable compression ratio mechanism for continuously varying a compression ratio of the engine, the variable compression ratio mechanism including a control shaft rotatably moveable to a rotational position corresponding to the compression ratio, a hydraulic actuator driving the control shaft to the rotational position depending on operating conditions of the engine, a hydraulic pressure source mechanically driven by the engine to produce a hydraulic pressure supplied to the hydraulic actuator, and a hydraulic control for variably controlling the hydraulic pressure supplied to the hydraulic actuator on the basis of the engine operating conditions.

19 Claims, 10 Drawing Sheets

VARIABLE COMPRESSION RATIO SYSTEM FOR INTERNAL COMBUSTION ENGINE AND METHOD FOR CONTROLLING THE SYSTEM

BACKGROUND OF THE INVENTION

The present invention relates to a variable compression ratio system for an internal combustion engine which is capable of continuously and variably controlling a compression ratio of the engine depending on engine operating conditions, and a method for controlling the system.

U.S. Pat. No. 6,491,003 (corresponding to Japanese Patent Application First Publication No. 2002-115571) discloses a variable compression ratio system for a reciprocating internal combustion engine. The variable compression ratio system uses a multiple-link type piston-crank mechanism for varying a position of a piston bottom dead center (BDC). The multiple-link type piston-crank mechanism includes upper and lower links linking a piston pin of a piston to a crankpin, and a control link linking the lower link to an eccentric cam of a control shaft. An actuator drives the control shaft to vary the rotational position depending on the engine operating conditions, whereby the compression ratio is variably controlled. The actuator may be an electric actuator, namely, an electric motor, or a hydraulic actuator.

SUMMARY OF THE INVENTION

In such a variable compression ratio system as the above-described related art, a load applied to the control link during the engine operation is transmitted to the eccentric cam of the control shaft to cause a rotation moment acting on the control shaft. The actuator, therefore, is required to drive the control shaft in the rotation direction against the rotation moment during the compression ratio varying operation and during the compression ratio holding operation. This causes increase in energy consumed for driving the actuator. Especially, in a case where the electric motor is used, the energy consumption will be more increased due to a low efficiency in converting the power output of the engine to that of the electric motor.

Further, a force applied to the control shaft is largely influenced by a combustion pressure produced when combustion takes place in the engine cylinder, and is varied depending on engine load. When the engine load is large even though the engine speed is low, a large rotation moment is applied to the control shaft. Therefore, in a case where the hydraulic actuator is used, the hydraulic actuator must be designed to produce a large output using a high hydraulic pressure so as to operate the control shaft against the large rotation moment. However, if such a high hydraulic pressure is used, a leakage from the hydraulic actuator and other parts, for instance, a selector valve, will be increased. This causes undesired increase in energy loss.

Further, torque required for rotating the control shaft upon controlling the compression ratio varies depending on engine speed and engine load. For instance, the required torque is small in a low-speed and low-load range of the engine. In such a case, the leakage from the hydraulic actuator, the selector valve and the like can be suppressed by reducing the hydraulic pressure supplied from the oil pump to the hydraulic actuator to a necessary and sufficient extent. This decreases the energy loss caused due to the leakage. Meanwhile, an amount of hydraulic fluid leaking from clearances varies in proportion to a square of a hydraulic pressure thereof. Further, if a hydraulic pressure is reduced upon supplying an amount of hydraulic fluid to the hydraulic actuator, energy consumption in driving the hydraulic actuator becomes smaller than that in a case where the hydraulic pressure is not reduced.

It is an object of the present invention to provide a variable compression ratio system for an internal combustion engine, which includes a variable compression ratio mechanism for continuously varying a compression ratio of the engine and a hydraulic actuator for driving the variable compression ratio mechanism depending on operating conditions of the engine, which is capable of reducing energy consumption required for driving the hydraulic actuator.

In one aspect of the present invention, there is provided a variable compression ratio system for an internal combustion engine, comprising:

- a variable compression ratio mechanism for continuously varying a compression ratio of the internal combustion engine, the variable compression ratio mechanism including a control shaft rotatably moveable to a rotational position corresponding to the compression ratio;
- a hydraulic actuator driving the control shaft to the rotational position depending on operating conditions of the internal combustion engine;
- a hydraulic pressure source mechanically driven by the internal combustion engine to produce a hydraulic pressure supplied to the hydraulic actuator; and
- hydraulic control means for variably controlling the hydraulic pressure supplied to the hydraulic actuator on the basis of the operating conditions of the internal combustion engine.

In a further aspect of the invention, there is provided a method for controlling a variable compression ratio system for an internal combustion engine, the variable compression ratio system including a variable compression ratio mechanism for continuously varying a compression ratio of the internal combustion engine, a hydraulic actuator driving the variable compression ratio mechanism, and a hydraulic pressure source mechanically driven by the internal combustion engine to produce a hydraulic pressure, the hydraulic actuator being supplied with the hydraulic pressure from the hydraulic pressure source via a hydraulic passage extending therebetween, the method comprising:

- detecting operating conditions of the internal combustion engine;
- determining a predetermined hydraulic pressure to be supplied to the hydraulic actuator on the basis of the detected operating conditions of the internal combustion engine;
- detecting a hydraulic pressure within the hydraulic passage; and
- controlling the hydraulic pressure supplied to the hydraulic actuator to the predetermined hydraulic pressure on the basis of the detected hydraulic pressure within the hydraulic passage.

DETAILED DESCRIPTION OF THE INVENTION

Figure 1:
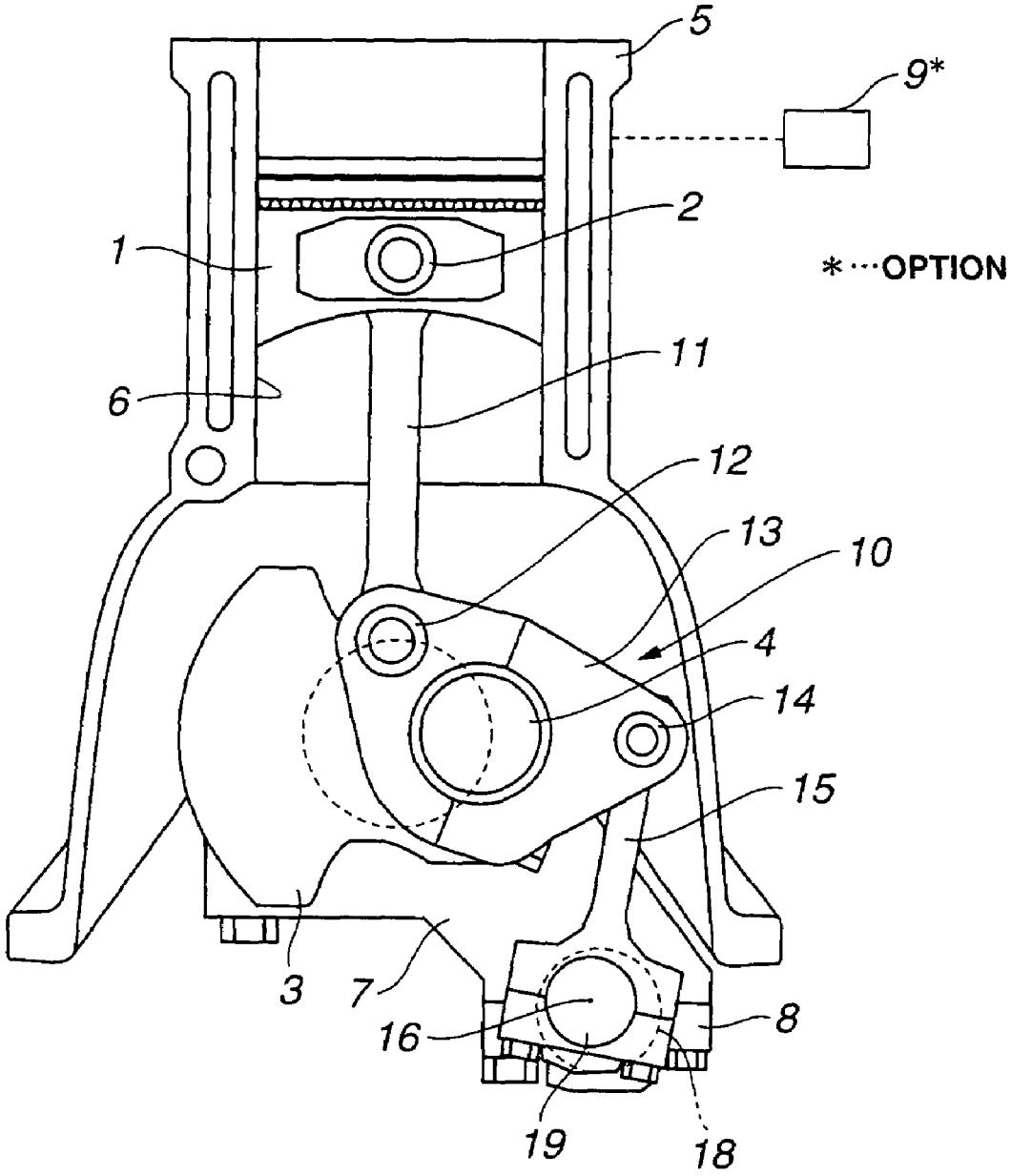
FIG. 1 is a cross section of a variable compression ratio mechanism of a variable compression ratio system of a first embodiment according to the present invention.

Referring to FIG. 1, there is shown a multiple-link type variable compression ratio mechanism 10 linked with a reciprocating internal combustion engine. Variable compression ratio mechanism 10 is operated by a hydraulic actuator explained later, so as to continuously vary a compression ratio of the engine. Here, the compression ratio is defined as the ratio of the volume in engine cylinder 6 above piston 1 when piston 1 is at bottom-dead-center (BDC) to the volume in engine cylinder 6 above piston 1 when piston 1 is at top-dead-center (TDC). Cylinder block 5 includes engine cylinders 6 one of which is illustrated in FIG. 1. Piston 1 is slidably disposed within engine cylinder 6. Piston 1 defines a combustion chamber within engine cylinder 6 to thereby undergo a combustion pressure that is produced when combustion takes place in the combustion chamber. Crankshaft 3 is rotatably supported on cylinder block 5 via crankshaft bearing bracket 7. Supercharger 9 may be used in the engine. Upper link 11 has one end pivotally coupled to piston 1 via piston pin 2 and an opposite end rotatably coupled to one end of lower link 13 via connecting pin 12. Lower link 13 has a central portion pivotally supported on crankpin 4 of engine crankshaft 3.

Lower link 13 has the other end to which one end of control link 15 is rotatably coupled to via connecting pin 14. Control link 15 has an opposite end pivotally supported on a portion of the engine body integrally formed with cylinder block 5. In order to vary the compression ratio of the engine, a pivot of the pivotal movement of the opposite end of control link 15 is arranged to be displaceable relative to the engine body. Specifically, control shaft 18 extending parallel to crankshaft 3 is provided with a generally cylindrical-shaped eccentric cam 19 whose center axis 16 is eccentric to a center axis of control shaft 18. The opposite end of control link 15 is rotatably fitted to an outer circumferential surface of eccentric cam 19. Control shaft 18 is rotatably supported between crankshaft bearing bracket 7 and control shaft bearing bracket 8.

When control shaft 18 is rotated in order to vary the compression ratio, center axis 16 of eccentric cam 19 serving as the pivot of control link 15 is displaced relative to the engine body. Owing to the displacement of the pivot of control link 15, the movement of each of lower link 13 and upper link 11 are varied. This causes change in stroke of piston 1 to thereby vary the compression ratio of the engine.

Figure 2:
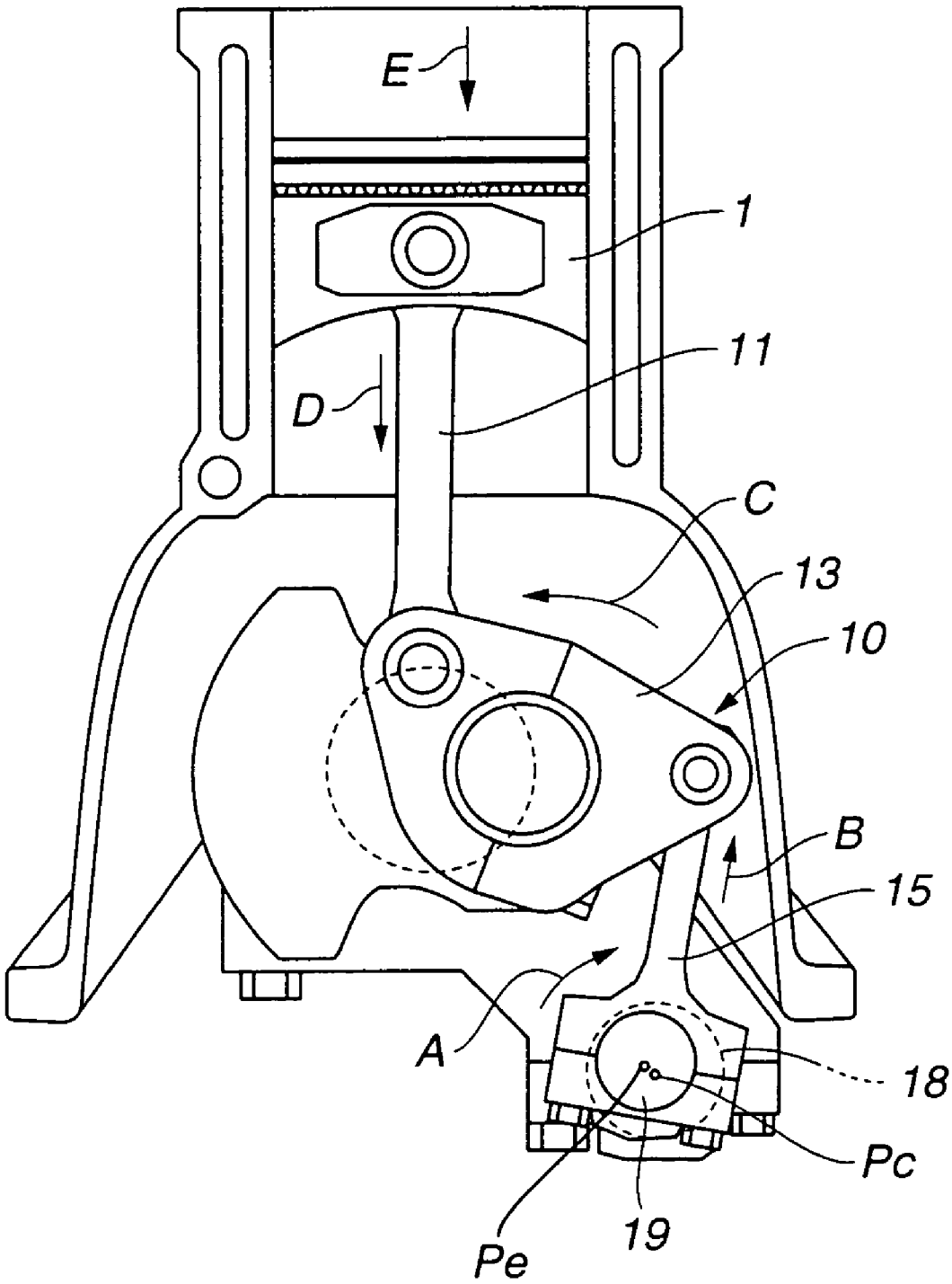
FIG. 2 is an explanatory diagram showing an operation of varying the compression ratio by rotating a control shaft of the variable compression ratio mechanism.

Referring now to FIG. 2, a relationship between a direction of movement of control shaft 18 and the compression ratio is explained. Reference characters Pc and Pe denote the center axis of control shaft 18 and the center axis of eccentric cam 19, respectively. As control shaft 18 is rotated, center axis Pe of eccentric cam 19 is displaced around center axis Pc of control shaft 18. In an initial position shown in FIG. 2, center axis Pe of eccentric cam 19 is positioned on the left side of center axis Pc of control shaft 18. When control shaft 18 is rotated in direction A, namely, a clockwise direction, center axis Pe of eccentric cam 19 upwardly moves and control link 15 is also moved upwardly as indicated by arrow B. The movement of control link 15 causes lower link 13 to pivotally move in direction C, namely, a counterclockwise direction. The pivotal movement of lower link 13 causes upper link 11 to move downwardly as indicated by arrow D. As a result, piston 1 is moved downwardly as indicated by arrow E, so that the compression ratio is reduced. Namely, when control shaft 18 is rotated in the clockwise direction to move from the initial position shown in FIG. 2, the compression ratio is reduced. On the other hand, when control shaft 18 is rotated in the counterclockwise direction to move from the initial position shown in FIG. 2, the compression ratio is increased.

Figure 3:
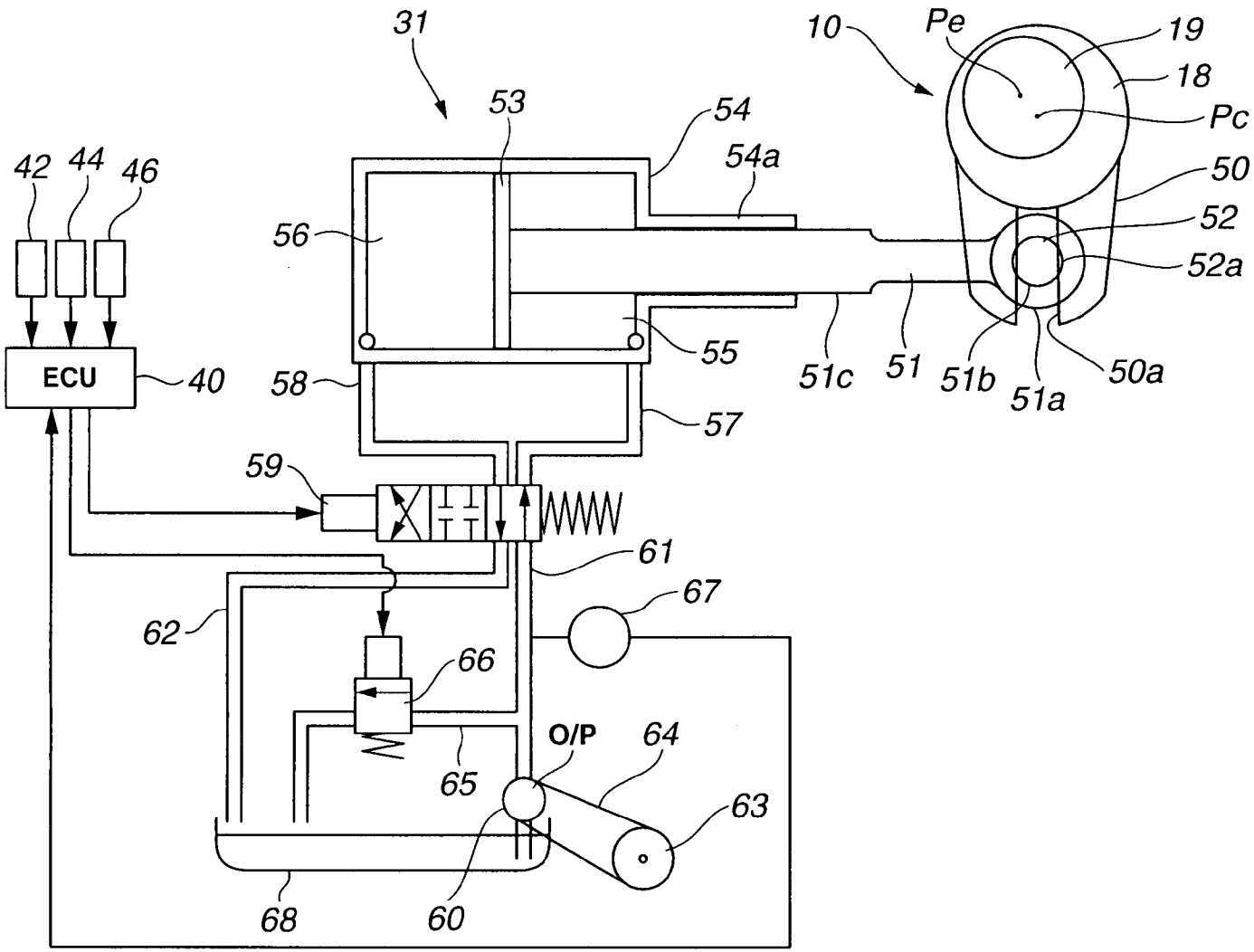
FIG. 3 is an explanatory diagram showing a hydraulic actuator for driving the variable compression ratio mechanism and a hydraulic control for controlling a hydraulic pressure supplied to the hydraulic actuator, which are used in the variable compression ratio system of the first embodiment.

Referring to FIG. 3, there is shown a hydraulic circuit for operating hydraulic actuator 31 which drives control shaft 18 in a rotation direction. In this embodiment, hydraulic actuator 31 is in the form of a double acting piston-cylinder mechanism including rod 51 which is linearly moveable in an axial direction thereof. A pair of levers 50 are fixedly arranged on control shaft 18 with a predetermined space therebetween in an axial direction of control shaft 18. Each of levers 50 has slit 50*a* extending in a radial direction of control shaft 18. Lever 50 and rod 51 are coupled to each other via generally cylindrical pin 52 which is moveably received in slit 50*a*. Specifically, pin 52 has two parallel surfaces 52*a* in a diametrically opposed relation to each other. Parallel surfaces 52*a* are formed on a circumferential surface of each of the opposite end portions of pin 52 so as to be slidably engaged in slit 50*a* of lever 50. Pin 52 has a cylindrical middle portion rotatably supported in pin hole 51*b* which is formed on one axial end portion 51*a* of rod 51. Rod 51 has large-diameter portion 51*c* slidably fitted to sleeve 54*a* extending outwardly from actuator housing 54. Rod 51 has disk-shaped piston 53 at an end of large-diameter portion 51*c* which is axially opposed to one axial end portion 51*a* with pin hole 51*b*. Actuator housing 54 is divided by piston 53 into first oil chamber 55 positioned on the side of control shaft 18 and second oil chamber 56 positioned on the side opposite to control shaft 18. Rod 51 extends through first oil chamber 55 and sleeve 54*a* toward control shaft 18.

Hydraulic actuator 31 is operated by hydraulic pressure discharged from oil pump 60 acting as a hydraulic pressure source. Oil pump 60 has hydraulic fluid and is mechanically coupled to and driven by crank pulley 63 of the engine via belt 64 to produce the hydraulic pressure supplied to hydraulic actuator 31. First and second oil chambers 55 and 56 of hydraulic actuator 31 are fluidly communicated with oil pump 60 and oil pan 68 via hydraulic path therebetween. Directional control valve 59 is disposed within the hydraulic path and electronically connected to engine control unit (ECU) 40, hereinafter referred to as a controller. Directional control valve 59 is operative to switch supply of the hydraulic pressure discharged from oil pump 60 to hydraulic actuator 31. In this embodiment, directional control valve 59 is in the form of a four-port three-position solenoid-operated valve. Directional control valve 59 selectively allows the fluid communication between each of first and second oil chambers 55 and 56 and oil pump 60 and the fluid communication between each of first and second oil chambers 55 and 56 and oil pan 68.

Specifically, directional control valve 59 is connected with first oil chamber 55 via hydraulic passage 57 and with second oil chamber 56 via hydraulic passage 58. Directional control valve 59 is also connected with a discharge port of oil pump 60 via supply passage 61 and with oil pan 68 via drain passage 62. Directional control valve 59 has a first open position where the fluid communication between first oil chamber 55 and oil pump 60 and the fluid communication between second oil chamber 56 and oil pan 68 are established. Directional control valve 59 has a second open position where the fluid communication between first oil chamber 55 and oil pan 68 and the fluid communication between second oil chamber 56 and oil pump 60 are established. Directional control valve 59 has a closed position where the fluid communication between each of first and second oil chambers 55 and 56 and each of oil pump 60 and oil pan 68 are blocked. Directional control valve 59 is controlled by controller 40 to shift between the first and second open positions and the closed position.

Variable relief valve 66 is disposed within relief passage 65 branched from supply passage 61. Variable relief valve 66 is electronically connected to controller 40 and operated to release an amount of the hydraulic fluid discharged from oil pump 60. Pressure sensor 67 is arranged to detect the hydraulic pressure in the hydraulic path upstream of selector valve 59, namely, in supply passage 61. Pressure sensor 67 is electronically connected to controller 40 and operated to transmit signal Ps indicative of the detected hydraulic pressure in supply passage 61.

In addition to pressure sensor 67, a plurality of sensors are electronically connected to controller 40. The sensors includes engine speed sensor 42, intake air flow sensor 44, and control shaft angle sensor 46. Engine speed sensor 42 detects engine speed, i.e., the number of engine revolution, and generates signal Ne indicative of the detected engine speed. Engine speed sensor 42 may be a crank angle sensor. Intake air flow sensor 44 detects an amount of intake air flowing into the combustion chamber of the engine and generates signal Qa indicative of the detected intake air amount. Intake air flow sensor 44 may be an intake airflow meter. Control shaft angle sensor 46 detects a rotational angle of control shaft 18 and generates signal $\epsilon r$ indicative of the detected rotational angle. Controller 40 receives signals Ne, Qa and $\epsilon r$ generated from sensors 42, 44 and 46 and processes signals Ne, Qa and $\epsilon r$ to obtain engine operating conditions. Depending on the engine operating conditions, controller 40 executes various controls including control of selector valve 59. Controller 40 may be a microcomputer including a central processing unit (CPU), input and output ports (I/O), a read-only memory (ROM) as an electronic storage medium for executable programs and calibration values, a random access memory (RAM), a keep alive memory (KAM), and a common data bus.

Controller 40 executes feedback control based on signal $\epsilon r$ generated by control shaft angle sensor 46 and transmits the control signal to selector valve 59. In response to the control signal, selector valve 59 shifts between the open positions so that the pressurized hydraulic fluid produced by oil pump 60 is introduced into one of first and second oil chambers 55 and 56, and at the same time, the hydraulic fluid within the other of first and second oil chambers 55 and 56 is drained. This causes pressure difference between first and second oil chambers 55 and 56 to thereby move piston 53 and rod 51 of hydraulic actuator 31 closer to control shaft 18 and away therefrom. As a result, control shaft 18 is driven to a desired rotational position corresponding to a target compression ratio.

Controller 40 is programmed to determine a desired opening degree of variable relief valve 66 based on signal Ps generated by pressure sensor 67. Namely, controller 40 is programmed to determine the amount of hydraulic fluid which is released through variable relief valve 66 when detected hydraulic pressure Ps within supply passage 61 is more than target hydraulic pressure Pt. Controller 40 transmits a control signal to variable relief valve 66. In response to the control signal, variable relief valve 66 is operated to the desired opening degree to release the amount of hydraulic fluid into oil pan 68. The hydraulic pressure within supply passage 61 is thus adjusted at target hydraulic pressure Pt.

Controller 40 is programmed to determine target hydraulic pressure Pt by selecting a larger one of a first hydraulic pressure required for satisfying responsivity of control shaft 18 upon varying the compression ratio of the engine and a second hydraulic pressure required for holding control shaft 18 at the rotational position to maintain the compression ratio of the internal combustion engine. The first hydraulic pressure is determined by calculating an amount of hydraulic fluid to be supplied to hydraulic actuator 31 during a target response period in which control shaft 18 must be operated from a certain stationary position to a rotational position. The responsivity of control shaft 18 is required for the main purpose of preventing occurrence of knocking when the engine load is increased. In order to prevent the occurrence of knocking, the compression ratio must be varied from a larger side to a smaller side. Upon the variation of the compression ratio, control shaft 18 is rotated in the same direction as the rotation moment applied thereto due to the combustion pressure generated in the combustion chamber of the engine. Therefore, the responsivity of control shaft 18 is more influenced by the hydraulic quantity supplied to hydraulic actuator 31 than by the hydraulic pressure supplied thereto. That is, the hydraulic quantity required for operating hydraulic actuator 31 is determined in relation to the responsivity of control shaft 18. As a result, by determining the hydraulic quantity required for operating hydraulic actuator 31 in transition of the compression ratio, the hydraulic pressure required for operating hydraulic actuator 31 can be determined based on characteristics of the hydraulic system including hydraulic actuator 31. On the other hand, the second hydraulic pressure means a hydraulic pressure required for holding control shaft 18 against the rotation force applied thereto in the same direction as the rotation moment applied thereto due to the combustion pressure. In other words, the second hydraulic pressure means the hydraulic pressure required for holding control shaft 18 against the rotation force applied thereto upon varying the compression ratio from the larger side to the smaller side. Control shaft 18 undergoes the rotation moment or load caused by the combustion pressure in many operating ranges of the engine.

Owing to the determination of target hydraulic pressure Pt by selecting the larger one of the first and second hydraulic pressures, the hydraulic pressure immediately upstream of directional control valve 59 can be reduced to a lower limit without adversely affecting the responsivity of control shaft 18 upon transition of the compression ratio. This serves for reducing energy consumption. Especially, an energy required for driving oil pump 60 can be decreased by reducing the hydraulic pressure immediately upstream of directional control valve 59. Further, an amount of the hydraulic fluid leaking from directional control valve 59 and hydraulic actuator 31 can be reduced, so that energy consumption required for replenishing the leakage amount of the hydraulic fluid can be suppressed.

Figure 4:
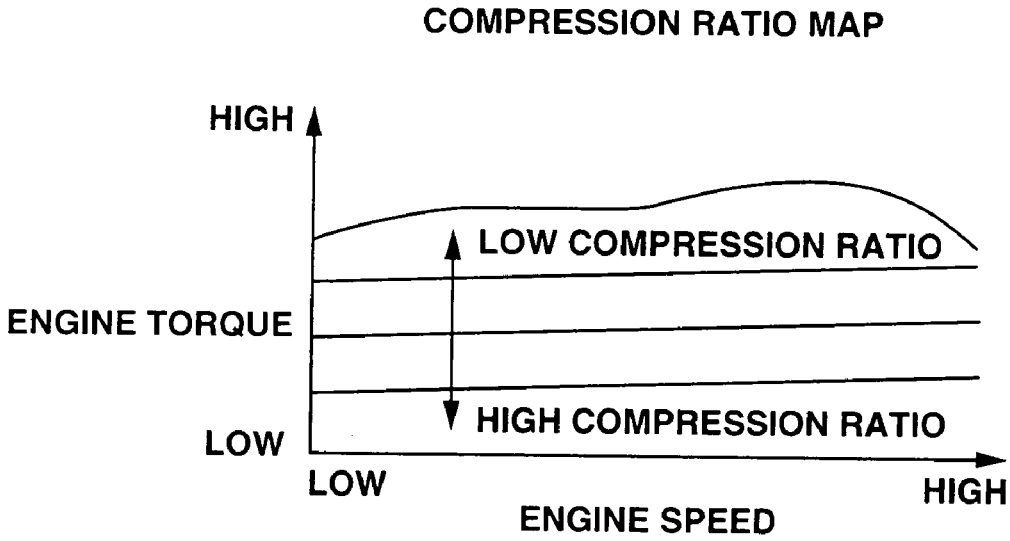
FIG. 4 is a map showing characteristic of compression ratio to be controlled relative to operating conditions of the engine.

FIG. 4 illustrates characteristic of compression ratio to be controlled relative to engine operating conditions, namely, engine speed and engine torque (load). In a range of low engine torque, the compression ratio is controlled to higher in order to enhance thermal efficiency. In contrast, in a range of high engine torque, the compression ratio is controlled to lower in order to prevent occurrence of knocking. Basically, as the engine torque becomes lower, the compression ratio is controlled to higher.

Figure 5:
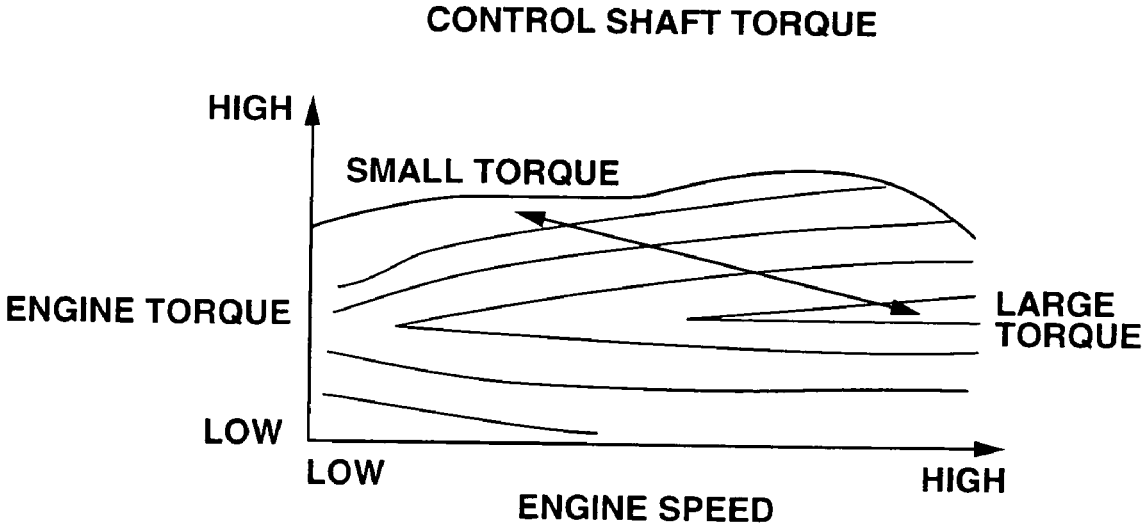
FIG. 5 is a map showing characteristic of torque required for driving the control shaft of the variable compression ratio mechanism.

FIG. 5 illustrates characteristic of a maximum torque required for driving control shaft 18, relative to engine speed and engine torque (load). As shown in FIG. 5, as the engine torque becomes lower, the required torque of control shaft 18 becomes larger. Meanwhile, since oil pump 60 is rotated synchronously with crankshaft 3 of the engine, the hydraulic pressure produced increases as the engine speed becomes higher.

Figure 6:
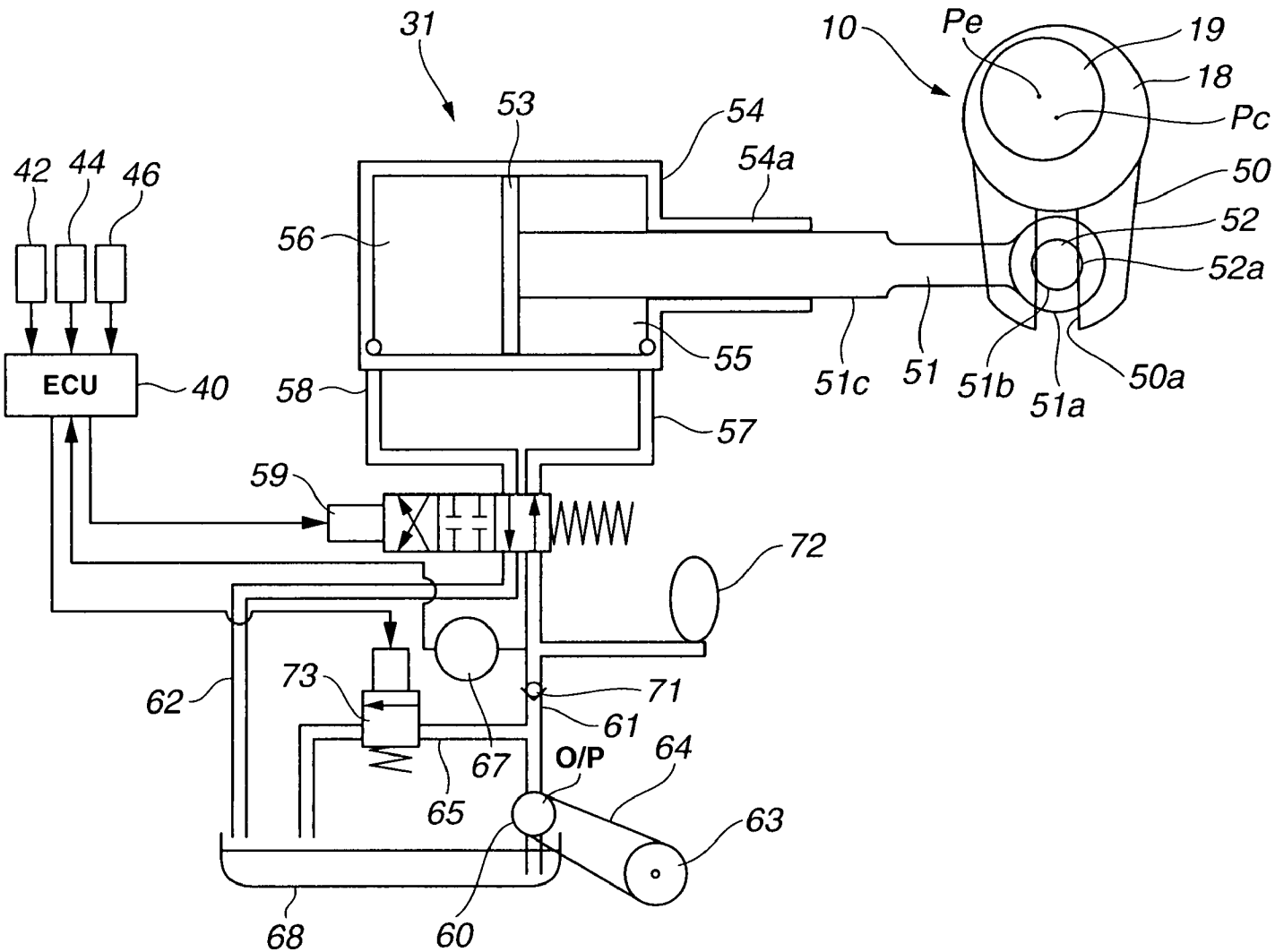
FIG. 6 is a diagram similar to FIG. 3, but showing the hydraulic actuator and the control device which are used in the variable compression ratio system of a second embodiment.

Referring to FIG. 6, there is shown a second embodiment of the variable compression ratio system which differs in the hydraulic control from the first embodiment. Like reference numerals denote like parts, and therefore, detailed explanations therefor are omitted. Check valve 71 is disposed within supply passage 61 between oil pump 60 and directional control valve 59. Hydraulic accumulator 72 is disposed between check valve 71 and directional control valve 59 and stores the hydraulic pressure discharged from oil pump 60 through check valve 61. Pressure sensor 67 detects the hydraulic pressure between check valve 71 and directional control valve 59, namely, the hydraulic pressure within hydraulic accumulator 72. Relief passage 65 is branched from an upstream portion of supply passage 61 which is located between check valve 71 and oil pump 60. Unloading valve 73 is disposed within relief passage 65. Unloading valve 73 is electronically connected to controller 40 and operated to release the hydraulic pressure discharged from oil pump 60 when the hydraulic pressure within hydraulic accumulator 72 is not less than a predetermined hydraulic pressure. The hydraulic pressure released from unloading valve 73 is fed to oil pan 68. With this arrangement, difference between the hydraulic pressure on the upstream side of oil pump 60 and the hydraulic pressure on the downstream side of oil pump 60 can be reduced so that energy consumption in driving oil pump 60 can be lowered.

Figure 7:
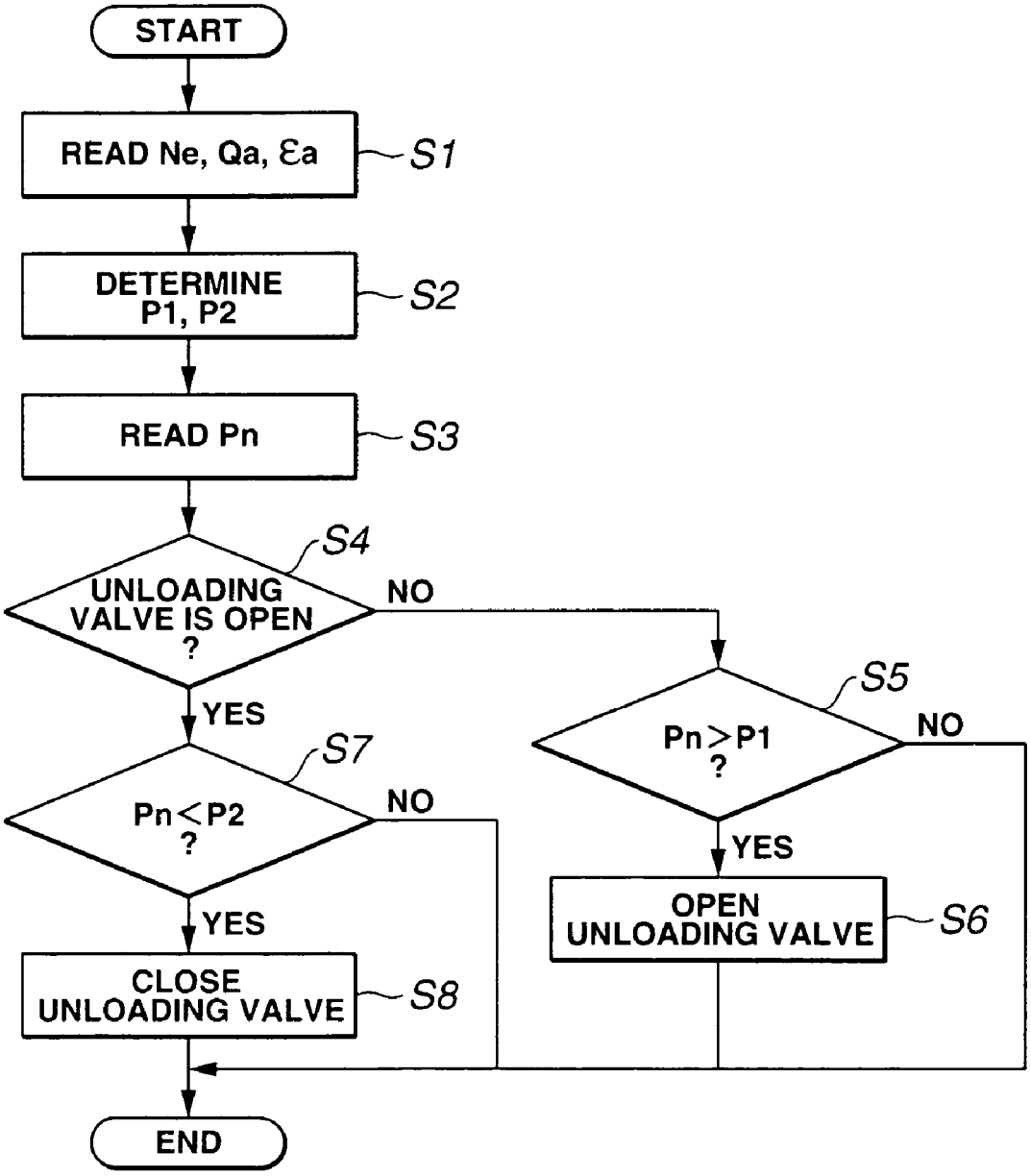
FIG. 7 is a flowchart illustrating hydraulic control logic of the variable compression ratio system of the second embodiment.

Referring to FIG. 7, there is shown a flow of the hydraulic control operation implemented by controller 40 in the second embodiment of FIG. 6. Logic flow starts and goes to block S1 where actual operating conditions of the engine are read. In this embodiment, the operating conditions are engine speed Ne, intake air amount Qa and compression ratio ea determined based on the detected rotational angle of control shaft 18. The logic flow goes to block S2 where upper limit pressure P1 and lower limit pressure P2 of hydraulic accumulator 72 are determined based on the operating conditions read at block S1. Here, assuming that target hydraulic pressure Pt is indicated at P0, the relationship between target hydraulic pressure P0 and upper and lower limit pressures P1 and P2 is expressed as follows: P0<P2<P1. The logic flow goes to block S3 where hydraulic pressure Pn within hydraulic accumulator 72 which is detected by pressure sensor 67 is read, and then goes to block S4. At block S4, an interrogation is made whether or not unloading valve 73 is open to allow release of the hydraulic pressure discharged from oil pump 60. If, at block S4, the interrogation is in negative, indicating that unloading valve 73 is closed to prevent release of the hydraulic pressure discharged from oil pump 60, the logic flow goes to block S5. At block S5, an interrogation is made whether or not detected hydraulic pressure Pn within hydraulic accumulator 72 is more than upper limit pressure P1. If, at block S5, the interrogation is in affirmative, the logic flow goes to block S6 where unloading valve 73 is opened. If, at block S5, the interrogation is in negative, the logic flow goes to end.

On the other hand, if, at block S4, the interrogation is in affirmative, indicating that unloading valve 73 is open, the logic flow goes to block S7. At block S7, an interrogation is made whether or not detected hydraulic pressure Pn within hydraulic accumulator 72 is less than lower limit pressure P2. If, at block S7, the interrogation is in affirmative, the logic flow goes to block S8 where unloading valve 73 is closed. If, at block S7, the interrogation is in negative, the logic flow jumps to end. Thus, hydraulic pressure Pn within hydraulic accumulator 72 can be always maintained between upper limit pressure P1 and lower limit pressure P2.

Figure 8:
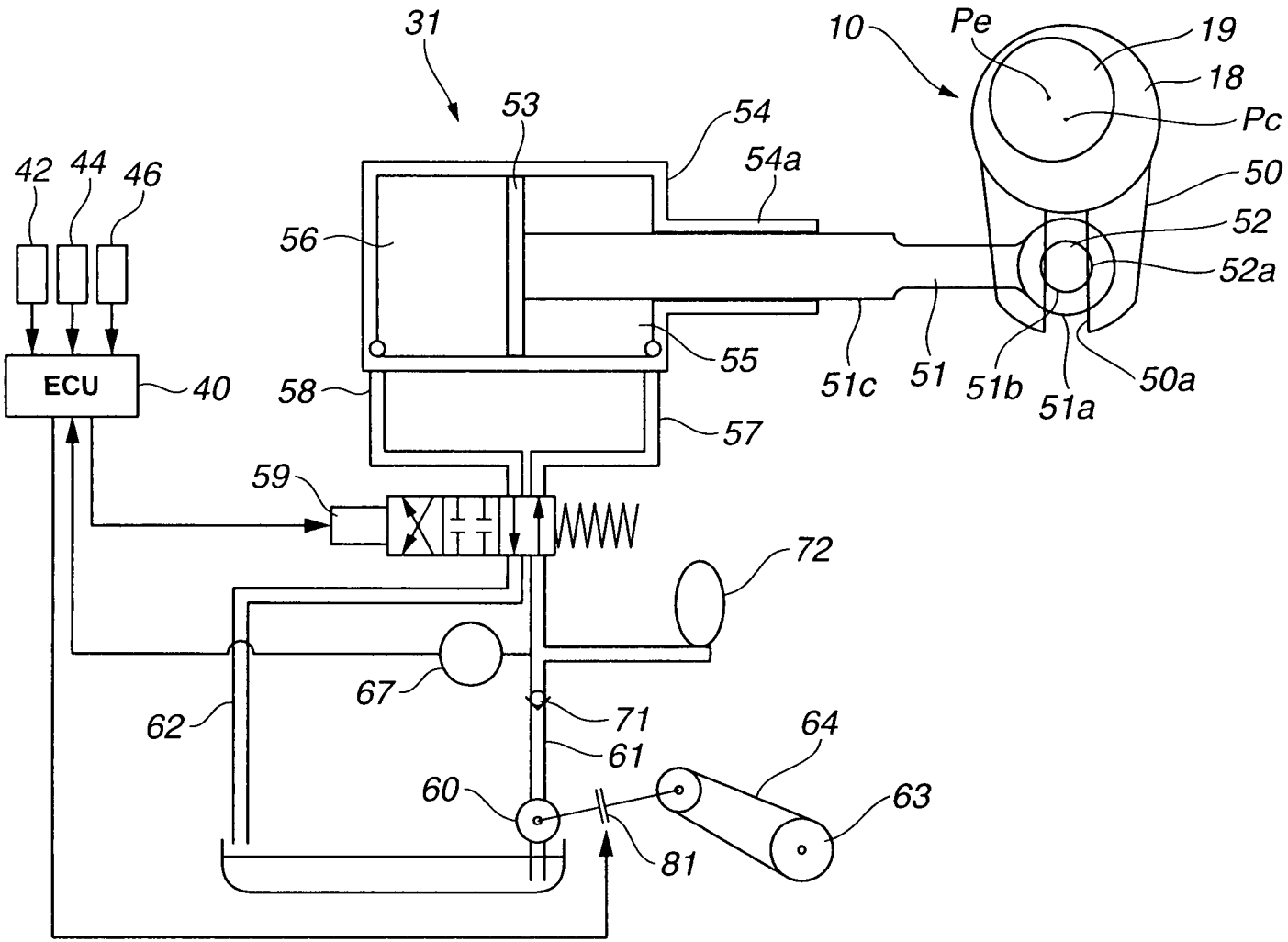
FIG. 8 is a diagram similar to FIG. 3, but showing the hydraulic actuator and the control device which are used in the variable compression ratio system of a third embodiment.

Next, referring to FIG. 8, there is shown a third embodiment of the variable compression ratio system which differs in that, instead of unloading valve 73 of the second embodiment, clutch mechanism 81 is provided for coupling oil pump 60 to the engine, from the second embodiment. Oil pump 60 is driven by engine crank pulley 63 through clutch mechanism 81. Clutch mechanism 81 may be formed by an electromagnetic clutch assembly. Clutch mechanism 81 is electronically connected to controller 40 and operated to allow the coupling between oil pump 60 and the engine to thereby drive oil pump 60 and prevent the coupling therebetween to thereby stop oil pump 60. With this arrangement, energy consumption in driving oil pump 60 can be reduced.

Figure 9:
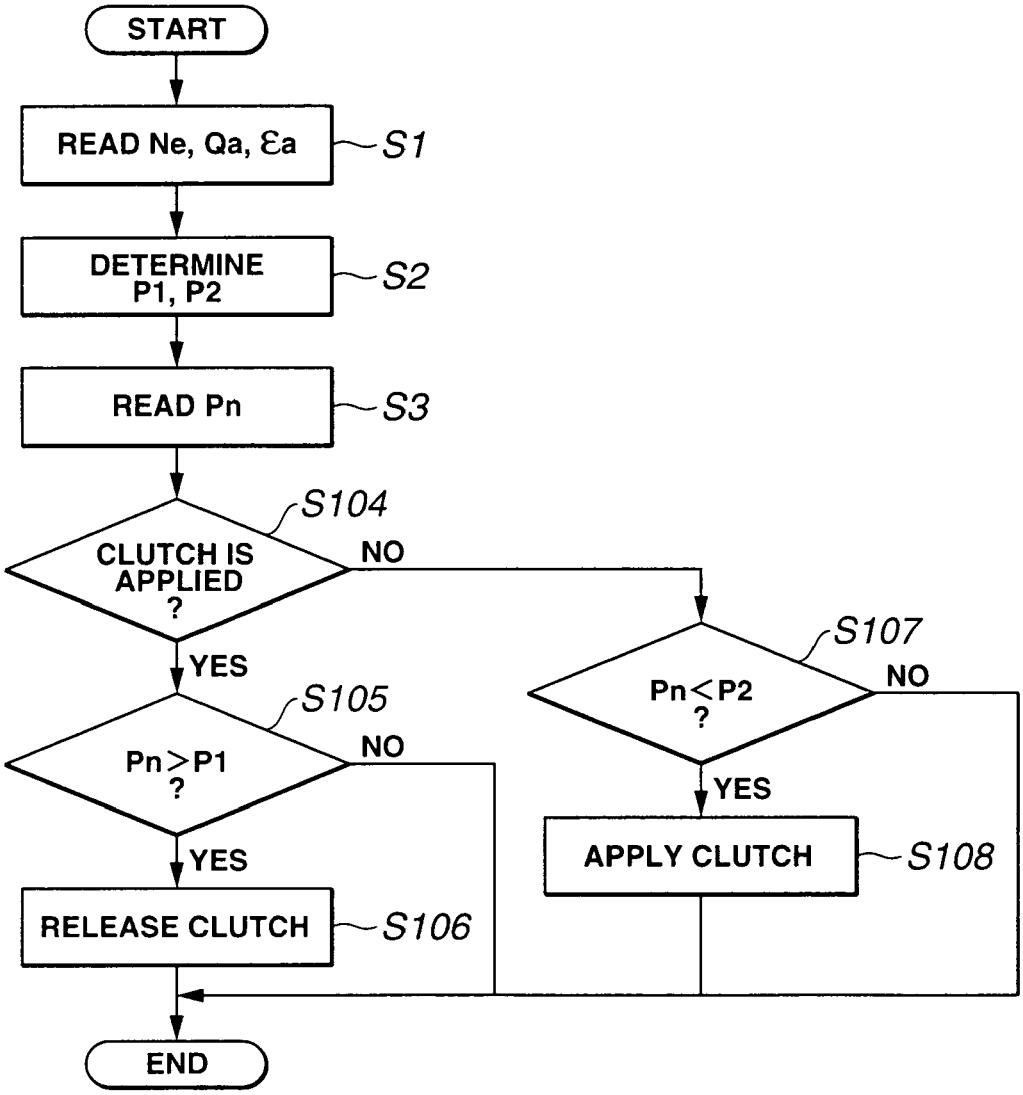
FIG. 9 is a flowchart illustrating hydraulic control logic of the variable compression ratio system of the third embodiment.

FIG. 9 illustrates a flow of the hydraulic control operation implemented by controller 40 in the third embodiment of FIG. 8. The flow differs in blocks S104 to S108 from the flow of the second embodiment. Similar to the second embodiment, there is the relationship P0<P2<P1 between target hydraulic pressure P0 and upper and lower limit pressures P1 and P2 determined at block S2. Subsequent to block S3, logic flow goes to block S104 where an interrogation is made whether or not clutch mechanism 81 is applied to allow the coupling between oil pump 60 and the engine. If, at block S104, the interrogation is in affirmative, the logic flow goes to block S105. At block S105, an interrogation is made whether or not detected hydraulic pressure Pn within hydraulic accumulator 72 is more than upper limit pressure P1. If, at block S105, the interrogation is in affirmative, the logic flow goes to block S106 where clutch mechanism 81 is released to prevent the coupling between oil pump 60 and the engine and thereby stop oil pump 60. If, at block S105, the interrogation is negative, the logic flow goes to end.

On the other hand, if, at block S104, the interrogation is in negative, indicating that clutch mechanism 81 is released, the logic flow goes to block S107. At block S107, an interrogation is made whether or not detected hydraulic pressure Pn within hydraulic accumulator 72 is less than lower limit pressure P2. If, at block S107, the interrogation is in affirmative, the logic flow goes to block S108 where clutch mechanism 81 is applied to allow the coupling between oil pump 60 and the engine and thereby restart oil pump 60. If, at block S107, the interrogation is in negative, the logic flow goes to end. Thus, hydraulic pressure Pn within hydraulic accumulator 72 can be always maintained between upper limit pressure P1 and lower limit pressure P2.

Figure 10:
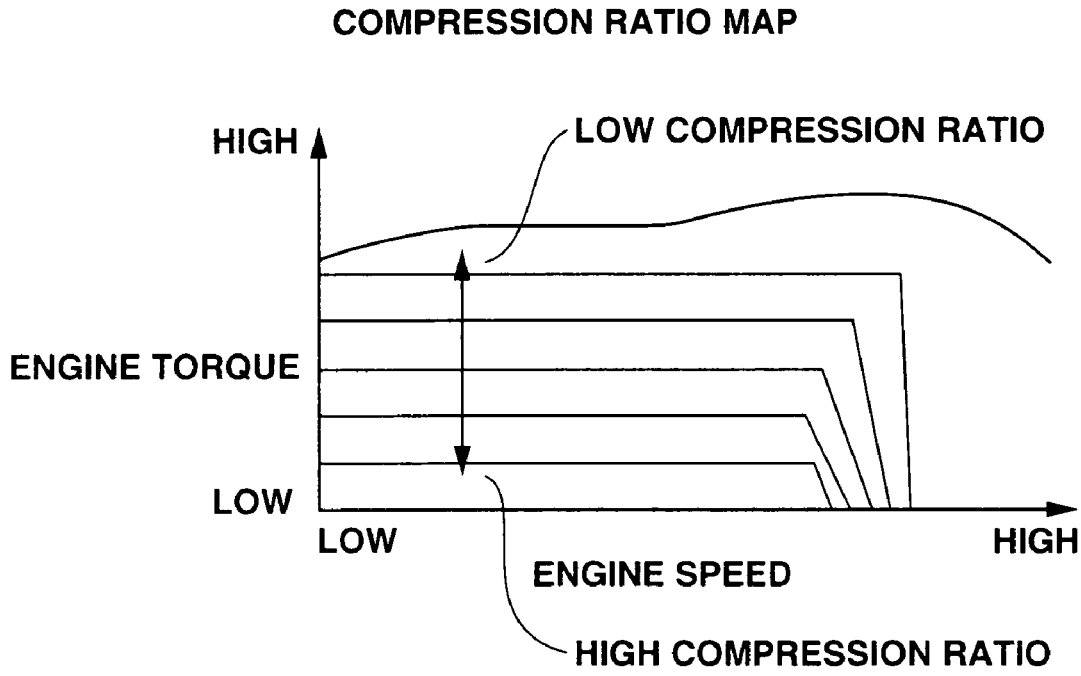
FIG. 10 is a map showing characteristic of compression ratio to be controlled relative to operating conditions of the engine which is used in a modification of the third embodiment.
Figure 11:
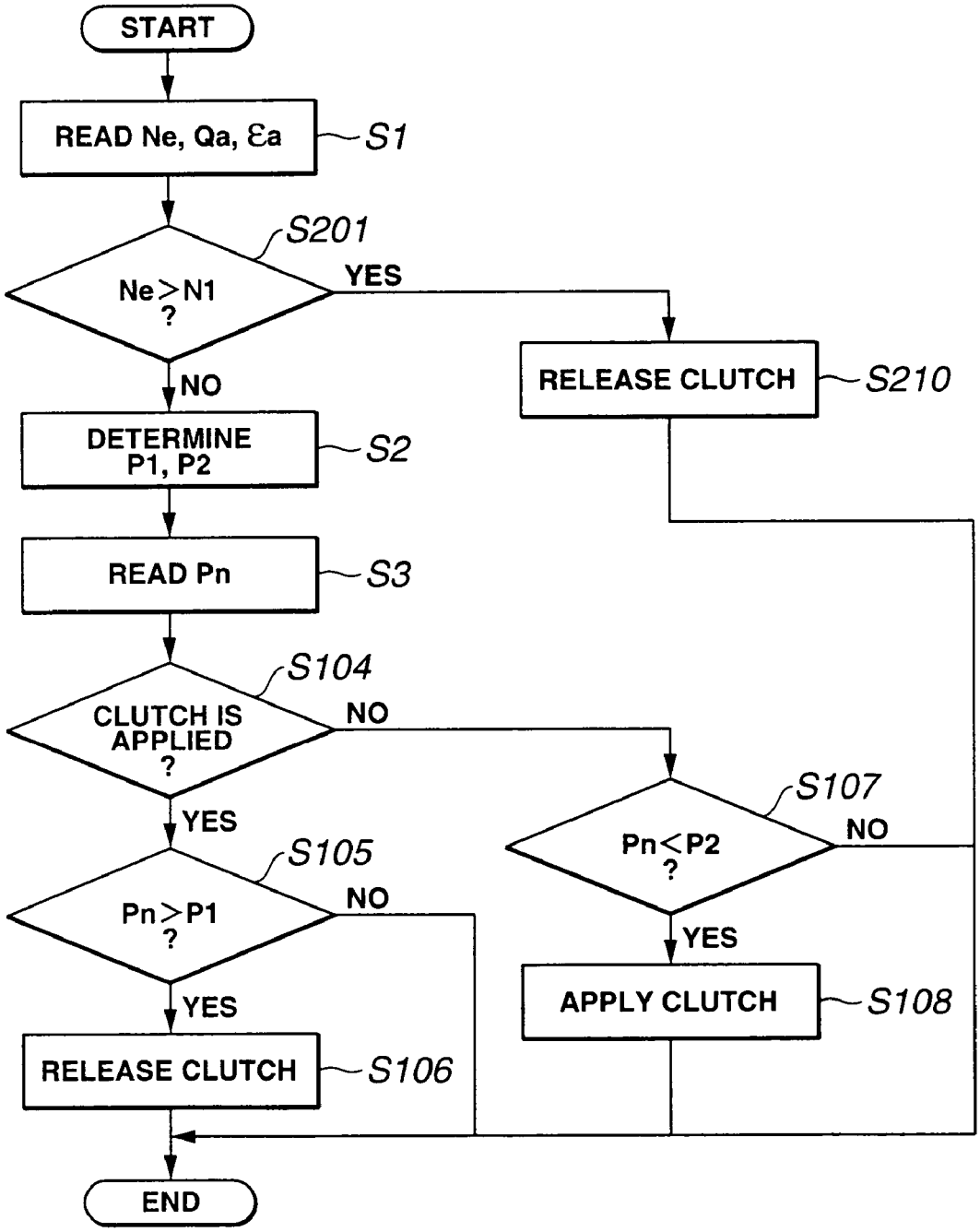
FIG. 11 is a flowchart illustrating hydraulic control logic of the variable compression ratio system of the modification of the third embodiment.

Referring to FIGS. 10 and 11, a modification of the third embodiment of the variable compression ratio system is explained. FIG. 10 illustrates characteristic of compression ratio to be controlled with respect to engine operating conditions, namely, engine speed and engine torque (load), which is used in the modification. In the modification, the compression ratio is controlled to a minimum at a predetermined high speed of the engine. The predetermined high speed may be 4000 rpm and be in a range from 3600 rpm to 4000 rpm. Variable compression ratio mechanism 10 may be provided with a stop which is arranged to stop control shaft 18 in a rotational position where the compression ratio is the minimum. In such a case, it will eliminate the hydraulic pressure which is required for holding control shaft 18 in the rotational position at the predetermined high speed of the engine. This is because the rotation moment applied to control shaft 18 due to the combustion pressure acts to rotate control shaft 18 in such a direction as to vary the compression ratio from the larger side to the smaller side, as explained above. Controller 40 is programmed to control the hydraulic pressure supplied to hydraulic actuator 31 so as to minimize the compression ratio and operate clutch mechanism 81 to prevent the coupling between oil pump 60 and the engine, when the engine is operated at the predetermined high speed.

FIG. 11 illustrates a flow of the hydraulic control implemented by controller 40 in the modification of the third embodiment. The flow differs in blocks S201 and S210 from the flow of the third embodiment. Subsequent to block S1, logic flow goes to block S201 where an interrogation is made whether or not detected engine speed Ne exceeds predetermined high speed N1. If, at block S201, the interrogation is in affirmative, the logic flow goes to block S210. At block S210, clutch mechanism 81 is released to prevent the coupling between oil pump 60 and the engine and stop oil pump 60. The logic flow then goes to end. If, at block S201, the interrogation is in negative, the logic flow goes to block S2.

In the modification, a maximum speed of oil pump 60 can be set at a lower value. This serves for reducing the size and weight of oil pump 60.

As explained in the embodiments and modification of the present invention, the hydraulic actuator is operated by the oil pump mechanically driven by the internal combustion engine. This can serve for increasing efficiency in using the engine output. Further, the hydraulic pressure supplied to the hydraulic actuator can be variably controlled to an adequate hydraulic pressure depending on the engine operating conditions. This can serve for suppressing energy consumption in driving the hydraulic actuator.

This application is based on a prior Japanese Patent Application No. 2002-320758 filed on Nov. 5, 2002. The entire contents of the Japanese Patent Application No. 2002-320758 is hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. A variable compression ratio system for an internal combustion engine, comprising:

a variable compression ratio mechanism for continuously varying a compression ratio of the internal combustion engine, the variable compression ratio mechanism including a control shaft rotatably moveable to a rotational position corresponding to the compression ratio;

a hydraulic actuator driving the control shaft to the rotational position depending on operating conditions of the internal combustion engine;

a hydraulic pressure source mechanically driven by the internal combustion engine to produce a hydraulic pressure supplied to the hydraulic actuator; and a hydraulic control mechanism to variably control the hydraulic pressure supplied to the hydraulic actuator on the basis of the operating conditions of the internal combustion engine, wherein the hydraulic control mechanism comprises a controller programmed to determine a target hydraulic pressure by selecting a larger one of a first hydraulic pressure required to allow rotation of the control shaft to vary the compression ratio of the internal combustion engine such that knocking does not occur in the engine and a second hydraulic pressure required for holding the control shaft at a rotational position to maintain the compression ratio of the internal combustion engine.

2. The variable compression ratio system as claimed in claim 1, wherein the hydraulic control mechanism comprises a selector valve electronically connected to the controller and operated to supply the hydraulic pressure from the hydraulic pressure source to the hydraulic actuator, the selector valve being disposed between the hydraulic actuator and the hydraulic pressure source, the controller being programmed to variably control a hydraulic pressure upstream of the selector valve based on the operating conditions of the internal combustion engine.

3. The variable compression ratio system as claimed in claim 2, further comprising a pressure sensor operative to detect the hydraulic pressure upstream of the selector valve and transmit a signal indicative of the detected hydraulic pressure, the controller being programmed to determine the hydraulic pressure supplied to the hydraulic actuator on the basis of the signal.

4. The variable compression ratio system as claimed in claim 3, wherein the hydraulic control mechanism comprises a variable relief valve disposed between the selector valve and the hydraulic pressure source, the variable relief valve being electronically connected to the controller and operated to release an amount of hydraulic fluid discharged from the hydraulic pressure source, the controller being programmed to determine the amount of hydraulic fluid to be released through the variable relief valve on the basis of the signal.

5. The variable compression ratio system as claimed in claim 3, wherein the hydraulic control mechanism comprises a check valve disposed between the selector valve and the hydraulic pressure source and a hydraulic accumulator disposed between the check valve and the selector valve, the controller being programmed to variably control a hydraulic pressure within the hydraulic accumulator.

6. The variable compression ratio system as claimed in claim 5, wherein the hydraulic control mechanism comprises an unloading valve disposed between the hydraulic pressure source and the check valve, the unloading valve being electronically connected to the controller and operated to release the hydraulic pressure discharged from the hydraulic pressure source when the hydraulic pressure within the hydraulic accumulator is more than a predetermined hydraulic pressure.

7. The variable compression ratio system as claimed in claim 5, wherein the hydraulic control mechanism comprises a clutch mechanism for coupling the hydraulic pressure source to the internal combustion engine, the clutch mechanism being electronically connected to the controller and operated to prevent the coupling between the hydraulic pressure source and the internal combustion engine when the hydraulic pressure within the hydraulic accumulator is more than a predetermined hydraulic pressure.

8. The variable compression ratio system as claimed in claim 7, wherein the operating conditions comprise engine speed, the controller is programmed to control the hydraulic pressure supplied to the hydraulic actuator so as to minimize the compression ratio of the internal combustion engine and operate the clutch mechanism to prevent the coupling between the hydraulic pressure source and the internal combustion engine, when the engine speed exceeds a predetermined speed.

9. The variable compression ratio system as claimed in claim 1, wherein the internal combustion engine has a supercharger.

10. The variable compression ratio system as claimed in claim 1, wherein the variable compression ratio mechanism comprises an upper link having one end coupled to a piston via a piston pin, a lower link pivotally coupled to the upper link and pivotally supported on a crankshaft via a crankpin, and a control link having one end pivotally coupled to the lower link and an opposite end pivotally supported on an eccentric cam disposed on the control shaft.

11. A method for controlling a variable compression ratio system for an internal combustion engine, the variable compression ratio system including a variable compression ratio mechanism for continuously varying a compression ratio of the internal combustion engine, a hydraulic actuator driving the variable compression ratio mechanism, and a hydraulic pressure source mechanically driven by the internal combustion engine to produce a hydraulic pressure, the hydraulic actuator being supplied with the hydraulic pressure from the hydraulic pressure source via a hydraulic passage extending therebetween, the method comprising:

detecting operating conditions of the internal combustion engine;

determining a predetermined hydraulic pressure to be supplied to the hydraulic actuator on the basis of the detected operating conditions of the internal combustion engine;

detecting a hydraulic pressure within the hydraulic passage; and controlling the hydraulic pressure supplied to the hydraulic actuator to the predetermined hydraulic pressure on the basis of the detected hydraulic pressure within the hydraulic passage.

12. The method as claimed in claim 11, wherein the predetermined hydraulic pressure comprises a target hydraulic pressure determined by selecting a larger one of a first hydraulic pressure required to allow rotation of a control shaft to vary the compression ratio of the internal combustion engine such that knocking does not occur in the engine and a second hydraulic pressure required for holding the variable compression ratio mechanism at an operational position to maintain the compression ratio of the internal combustion engine.

13. The method as claimed in claim 11, wherein the variable compression ratio system comprises a selector valve disposed between the hydraulic actuator and the hydraulic pressure source, the selector valve being operative to switch supply of the hydraulic pressure to the hydraulic actuator via the hydraulic passage.

14. The method as claimed in claim 13, wherein the detecting operation comprises detecting a hydraulic pressure within the hydraulic passage between the selector valve and the hydraulic pressure source, the method further comprising comparing the detected hydraulic pressure within the hydraulic passage between the selector valve and the hydraulic pressure source with the predetermined hydraulic pressure, the controlling operation comprising reducing the hydraulic pressure within the hydraulic passage when the detected hydraulic pressure within the hydraulic passage between the selector valve and the hydraulic pressure source is more than the predetermined hydraulic pressure.

15. The method as claimed in claim 14, wherein the reducing operation comprises releasing an amount of hydraulic fluid within the hydraulic passage between the selector valve and the hydraulic pressure source when the detected hydraulic pressure within the hydraulic passage between the selector valve and the hydraulic pressure source is more than the predetermined hydraulic pressure.

16. The method as claimed in claim 15, wherein the variable compression ratio system further comprises a check valve disposed between the selector valve and the hydraulic pressure source, and the predetermined hydraulic pressure is an upper limit pressure within the hydraulic passage between the selector valve and the check valve.

17. The method as claimed in claim 16, further comprising comparing the detected hydraulic pressure within the hydraulic passage between the selector valve and the check valve with the upper limit pressure.

18. The method as claimed in claim 14, wherein the reducing operation comprises preventing the coupling between the hydraulic pressure source and the internal combustion engine.

19. The method as claimed in claim 14, wherein the operating conditions comprise engine speed, the method further comprising comparing the detected engine speed with a predetermined speed, the reducing operation comprising preventing the coupling between the hydraulic pressure source and the internal combustion engine when the detected engine speed exceeds predetermined speed.

* * * * *